United States Patent [19]

Sumiyoshi et al.

[11] 4,211,201

[45] Jul. 8, 1980

[54] FUEL SUPPLY APPARATUS FOR INTERNAL COMBUSTION ENGINES

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Asian Industry Co., Ltd., Ohbu, both of Japan

[21] Appl. No.: 900,506

[22] Filed: Apr. 27, 1978

[30] Foreign Application Priority Data

May 4, 1977 [JP] Japan ..... 52/51554

[51] Int. Cl.[2] ..... F02M 69/00

[52] U.S. Cl. ..... 12/463; 123/464; 123/465; 123/445

[58] Field of Search ..... 123/139 AW, 119 R

[56] References Cited

U.S. PATENT DOCUMENTS

| | | | |
|---|---|---|---|
| Re. 25,701 | 12/1964 | Armstrong | 123/139 AW |
| 2,876,758 | 3/1959 | Armstrong | 123/139 AW |
| 3,006,329 | 10/1961 | Armstrong et al. | 123/139 AW |
| 3,416,504 | 12/1968 | Jackson | 123/139 AW |
| 3,482,558 | 12/1969 | Casey | 123/139 AW |
| 3,650,258 | 3/1972 | Jackson | 123/139 AW |
| 4,034,721 | 7/1977 | Lenzi et al. | 123/139 AW |
| 4,046,121 | 9/1977 | Pierlot | 123/139 AW |
| 4,050,431 | 9/1977 | Jackson | 123/139 AW |

*Primary Examiner*—Wendell E. Burns

*Attorney, Agent, or Firm*—Cushman, Darby & Cushman

[57] ABSTRACT

A fuel supply apparatus for an internal combustion engines comprises a throttle valve disposed in an intake conduit leading to the internal combustion engine, an air valve disposed in the intake conduit upstream of the throttle valve so as to define an air pressure chamber in the intake conduit in cooperation with the throttle valve, a device for controlling the air valve in response to the pressure prevailing in the air pressure chamber so that the pressure be maintained at a substantially constant level, and a fuel metering device including a variable throttle passage provided in a fuel feed conduit opening in the intake conduit through a fuel injection valve and interlocked with the air valve to be controlled so that the flow section area of the throttle passage may be proportional to the opening degree of the air valve, and a device for maintaining difference in pressure produced across the variable throttle passage at a predetermined value. The air valve controlling device includes a feedback control system which comprises a device for producing a signal of a level corresponding to the pressure prevailing in the air pressure chamber in the intake conduit, and a device responding to the signal for controlling the air valve so that the pressure within the air pressure chamber be maintained at a set valve, and further includes a device for automatically changing the level of the signal representative of the pressure level in the air pressure chamber in dependence on the environmental and operating conditions of the engine such as embient temperature, atmospheric pressure, engine temperature, deceleration and acceleration of the engine and the like, thereby to vary the intake air quantity to attain an optimum air-fuel ratio for the instantaneous operating condition of the engine.

14 Claims, 6 Drawing Figures

FUEL SUPPLY APPARATUS FOR INTERNAL COMBUSTION ENGINES

BACKGROUND OF THE INVENTION

1. Field of the Invention

The present invention relates in general to a fuel supply apparatus for an internal combustion engine of a fuel injection type. In particular, the invention concerns a fuel supply apparatus in which intake air quantity is detected by an air valve disposed within an intake conduit upstream of a throttle valve and adapted to be so controlled that pressure in an air pressure chamber defined between the air valve and the throttle valve may be maintained constant, while fuel quantity to be supplied to the internal combustion engine is controlled by a fuel metering assembly operationally interlocked with the air valve so as to be proportional to the intake air quantity.

2. Description of the Prior Art

The fuel supply apparatus of the above type permits a predetermined air-fuel ratio of air-fuel mixture to be established with a relatively high accuracy during normal operation of internal combustion engines, whereby purification of exhaust gas from the engine can be accomplished to a reasonable degree. However, in order to attain an adequate and satisfactory purification of the exhaust gas under all various operating conditions of the engine, it is necessary to perform correction on the air-fuel ratio in consideration of the instantaneous operating and environmental conditions such as temperature of ambient air, atmospheric pressure, temperature of the engine, acceleration and deceleration of the engine and the like.

From Japanese Laid-Open patent application No. 38220/73, which corresponds to U.S. Pat. No. 3,809,036, a fuel supply apparatus of the aforementioned type has been already known in which the ratio of the metered fuel quantity relative to the intake air quantity is caused to vary by correspondingly varying a fuel pressure difference produced across the fuel metering device in dependence on a certain specified operating condition of the engine, thereby to permit the air-fuel ratio to be corrected to obtain the optimum ratio. However, this known apparatus is disadvantageous in that the structure is complicated, the air-fuel ratio is corrected merely in response to change of only one factor representing a specified operating condition of the engine, and a fine control of the air-fuel ratio can not be accomplished in a satisfactory manner due to the fact that the apparatus is operated on the basis of proportional control principle and thus exhibits unstable follow-up performance in response to abrupt changes in the intake air quantity.

SUMMARY OF THE INVENTION

A primary object of the present invention is to provide a fuel supply apparatus for internal combustion engines of the aforementioned type which allows the air-fuel ratio to be corrected in response to changes or variations in numerious factors representing various operating conditions or states of the internal combustion engine with a view to attaining an optimum operation with a simplified structure.

Another object of the invention is to provide a fuel supply apparatus of the above described type which includes an air-fuel ratio controlling system operative based on the integration control principle and capable of following up transient conditions with an acceptable response delay.

In view of the above and other objects which will become more apparent as description proceeds, there is proposed according to one aspect of the invention a fuel supply apparatus for an internal combustion engine which comprises essentially a throttle valve disposed in an intake conduit, an air valve disposed in the intake conduit upstream of the throttle valve, means for controlling the air valve in response to pressure prevailing within an air pressure chamber defined between the air valve and the throttle valve so that the pressure may be maintained at a substantially constant level, and a fuel metering means including a variable throttle passage provided in a fuel feed conduit and interlocked with the air valve to be controlled so that the flow section area of the throttle passage may be proportional to opening area of the air valve, and a device for maintaining difference in pressure produced across the variable throttle passage at a predetermined value. In the fuel supply apparatus described above, according to the teachings of the invention, the air valve controlling means includes a feedback control system which comprises a device for generating a signal of a level corresponding to the pressure prevailing in the air pressure chamber defined between the throttle valve and the air valve in the intake conduit, and a device for responding to the signal thereby to control the air valve so that the pressure within the air pressure chamber be maintained at a set value, and further includes a device for automatically changing the level of the above signal representing the pressure level in the air pressure chamber in dependence on the environmental and operating conditions of the internal combustion engine. When the signal level is changed in this way, the set level of pressure in the air pressure chamber will undergo corresponding variation. Consequently, even when the opening degree of the air valve is held at a constant value, the air quantity flowing through the air valve is varied to correspondingly change the air-fuel ratio, because the pressure difference produced across the air valve is changed.

In a preferred embodiment of the invention, the signal generating device includes a pilot valve having a reference pressure chamber and a spool which is provided with a pressure receiving and surface faced toward the reference pressure chamber and is resiliently urged toward the reference pressure chamber. The spool is adapted to be displaced in dependence of pressure changes in the air pressure chamber or compartment defined between the throttle valve and the air valve. The air valve controlling device includes a hydraulically actuated piston controlled in accordance with the displacement of the spool of the pilot valve. There are additionally provided a high pressure fuel supply source and a low pressure fuel supply source, each of which is maintained at a predetermined pressure level relative to the atmospheric pressure, and the pressure chamber of the pilot valve is disposed at an intermediate location of a path through which the high and low pressure fuel sources are communicated with each other. Disposed further in the hydraulic circuits provided at the upstream and downstream sides of the pressure chamber of the pilot valve are a cut-off valve, a variable throttle means, a variable volume chamber and the like which are, respectively, adapted to respond to several factors representing various environmental and operating conditions of the internal combustion engine, thereby to correspondingly control or vary the flow resistances and flow rates in the hydraulic circuits in order to automatically vary the pressure level in the reference pressure chamber of the pilot valve. As a result, the balanced condition of forces acting on the spool of the pilot valve is varied so as to cause the set value of pressure in the air pressure chamber to be correspondingly changed.

The feedback control system for controlling the air valve which is composed of the pilot valve and the hydraulically actuated piston is operative on the basis of integration principle. Thus, the control system can advantageously follow up rapidly any abrupt changes in the intake air flow. It is preferred that the high pressure fuel source and the low pressure fuel source be utilized as the hydraulic pressure source for actuating the hydraulically actuated piston.

The above and other objects, novel features and advantages of the invention will become more apparent from the description on exemplary embodiments of the invention taken in conjunction with the accompanying drawings.

DETAILED DESCRIPTION OF THE PREFERRED EMBODIMENTS

Figure 1:
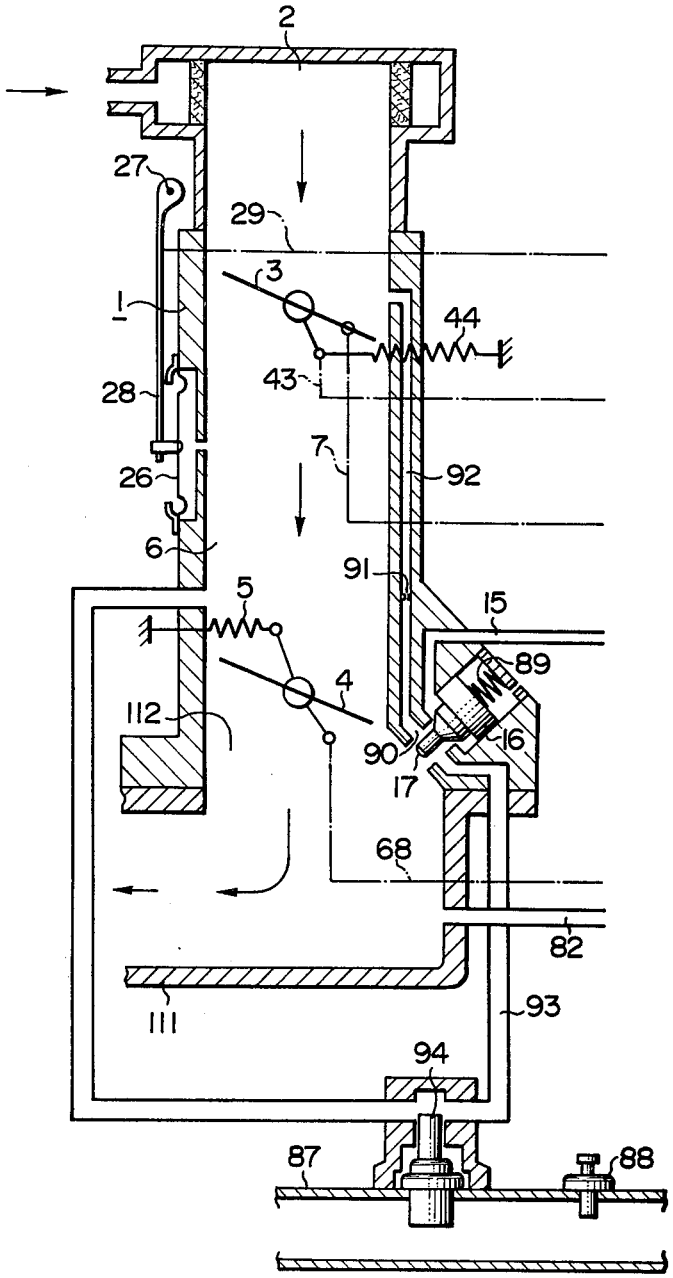
FIG. 1 is a sectional view showing schematically an air intake conduit portion of an internal combustion engine to be combined with a fuel supply apparatus according to the invention.

Referring to FIG. 1 which shows in a sectional view an intake conduit portion of an internal combustion engine provided with a fuel supply apparatus according to an embodiment of the invention, reference numeral 1 denotes a main body of the apparatus which includes an air cleaner 2 mounted at the top inlet port thereof as well as an air valve 3 and a throttle valve 4 disposed therein. Air as sucked through the air cleaner 2 passes through the air valve 3 and the throttle valve 4 to an intake conduit 111 and hence fed to the engine cylinders through intake ports (not shown). The throttle valve 4 is usually biased toward the closing position under the action of a spring 5 and adapted to control intake air flow through angular displacement thereof as caused by corresponding actuation of an acceleration pedal (not shown) of a motor vehicle, as is well known in the art. On the other hand, the direction in which the air valve 3 is rotated depends on the quantity of intake air, i.e. the air valve 3 is rotated in the opening direction as the intake air flow is increased, while the valve 3 is revolved in the closing direction as the intake air flow is decreased. The angular position taken by the air valve is controlled by a feedback control apparatus described hereinafter in such a manner that the air pressure in an air pressure chamber 6 defined between the air valve 3 and the throttle valve 4 within the mainbody 1 will remain constant during normal operation of the engine. The air valve 3 is coupled to a fuel metering rod 8 shown in FIG. 2 through a linkage represented by a dotted broken line 7. The fuel metering rod 8 is slidably disposed within a cylinder 9 and adapted to be axially displaced as the air valve 3 is rotated. In this connection, it is to be noted that the connection between the air valve 3 and the fuel metering rod 8 through the coupling linkage 7 is made such that the displacement of the fuel metering rod 8 is proportional to changes in the opening degree of the air valve 3, i.e. changes in area of gap defined between the outer periphery of the air valve 3 and the cylindrical inner wall of the main body 1. As can be seen from FIG. 2, the fuel metering rod 8 has an inner end portion 10 located within the cylinder 9 and formed with a counter-bore or hollow portion around the axis thereof. A pair of slits 10*a* are formed axially in the peripheral wall of the hollow end portion 10. A passage 11 which is communicated with a fuel supply source (a high pressure fuel source 20 described hereinafter) is opened into the cylinder 9 at the closed end thereof. Further, the cylinder 9 is formed with an annular groove 12 in the inner wall into which a passage 13 is opened. With such arrangement, the fuel flowing into the cylinder 9 through the passage 11 will flow through the slits 10*a* formed in the hollow end portion 10 of the metering rod 8 into the annular groove 12 and hence into the passage 13. The slits 10*a* formed in the cylindrical hollow portion 10 and the annular groove 12 thus constitute a variable throttle passage having a variable flow section which can be variably set in dependence upon the degree of superposition between the slits 10*a* and the annular groove 12, thereby to meter the fuel flow from the passage 11 into the passage 13. In this conjunction, it should be recalled that the fuel metering rod 8 is interlocked with the air valve 3 so that the position of the rod 8 may proportionally depend on the opening degree of the air valve 3. Consequently, the flow section of the variable throttle passage formed by the slits 10*a* and the annular groove 12 will vary in proportion to variation in the opening degree of the air valve 3. The fuel thus metered through the metering rod assembly 8 flow through the passage 13 and hence to a fuel injection valve 16 (FIG. 1) through a passage 15. Upon opening of the injection valve 16 under the pressure of fuel, the latter is injected into the interior space 112 of the intake conduit through a fuel discharge nozzle 17 located downstream of the throttle valve 4.

Figure 2:
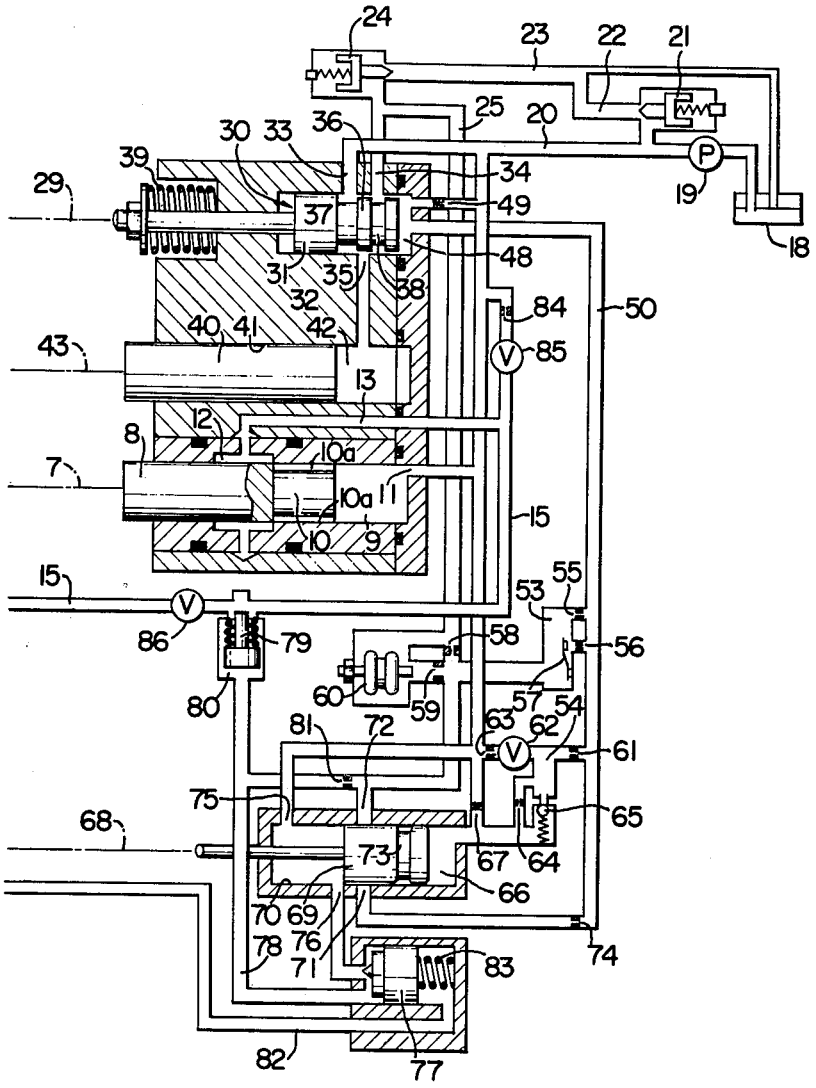
FIG. 2 is a sectional view showing schematically a general arrangement of a fuel supply apparatus according to an embodiment of the invention.

In FIG. 2, the fuel contained in a fuel tank 18 is fed under pressure by means of a fuel pump 19, whereby a portion of the pumped fuel is injected into the interior 112 of the intake conduit 111 from the fuel discharge nozzle 17 after having been metered by the fuel metering rod 8, while the remaining part of the fuel is returned to the fuel tank 18 after having been utilized as active fluid for various control elements incorporated in the fuel supply apparatus according to the invention. A conduit 20 connected to the exit side of the fuel pump 20 is communicated with a fuel return passage or conduit 23 through a by-pass conduit 22 provided with a high pressure valve 21, thereby constituting a high pressure fuel source maintained at a high pressure with a constant pressure difference relative to the atmospheric pressure. A low pressure valve 24 is installed in the return conduit 23 upstream of the junction between the return conduit 23 and the by-pass conduit 22, whereby a low pressure fuel source 25 is constituted upstream of the low pressure valve 24 which maintains a constant pressure difference smaller than that of the high pressure fuel source 20 relative to the atmospheric pressure.

As described hereinbefore, the pressure prevailing in the pressure chamber 6 defined between the air valve 3 and the throttle valve 4 is maintained constant independently of the intake air flow or quantity with the aid of the feedback control system during normal operation. In a typical embodiment of the feedback control system described below, the fuel from the high pressure fuel source 20 as well as the low pressure fuel source 25 is advantageously utilized for the operation of the control system.

Formed in the outer wall of the main body 1 at location where the air pressure chamber 6 is formed in the interior thereof is a recess which is communicated to the air pressure chamber 6 and covered by a diaphragm 26. An arm 28 pivotally mounted at 27 is attached at its free end to the diaphragm 26 so that variation in pressure within the air pressure chamber 6 may give rise to a pivotal movement of the arm 28 through the diaphragm 26. Thus, the diaphragm functions as a pressure sensor for detecting pressure prevailing in the air pressure chamber 6. The movement of the arm 28 is transmitted to a spool 31 of a pilot valve 30 shown in FIG. 2 through a connecting link represented by a dotted broken line 29. Two ports 33 and 34 are opened in a bore 32 accommodating slidably the spool 31, which ports 33 and 34 are communicated to the high pressure fuel source 20 and the low pressure fuel source 25, respectively. There is formed in the bore 32 at the right hand side of the spool 31 as viewed in FIG. 2 a reference pressure chamber 48 which is communicated to the high pressure fuel source 20 through a fixed orifice 49. The reference pressure chamber 48 is further communicated to the low pressure fuel source 25 in addition to the high pressure fuel source 20 through numerious fixed orifices, various valves and variable orifices, as will be described hereinafter. At the side opposite to the ports 33 and 34, there is formed a port 35 in the bore 32 which is located at a middle position between the ports 33 and 34, as viewed in the axial direction of the bore 32. The spool 31 is further formed with two annular grooves 37 and 38 which are partitioned by a land 36 having a width substantially equal to the diameter of the port 35 and communicated to the ports 33 and 34, respectively. The spool 31 is maintained in a balanced position under the pressure in the reference pressure chamber 48, influence of a spring 39 and the force exerted by the arm 28 of the pressure sensor 26 so that the fuel flow from the port 33 into the port 35 is balanced with the fuel flow from the port 35 into the port 34 when the pressure within the air pressure chamber 6 defined within the main body 1 is at a preset level so long as the pressure within the pressure 48 remains unvaried. The port 35 is communicated with a chamber 42 defined in a cylinder 41 by an air valve drive piston 40 accommodated therein at the rear (or right hand) side of the piston 40. The air valve drive piston 40 is connected to the air valve 3 through a link represented by a dotted broken line 43. The air valve 3 is usually urged toward the closing position under the action of a tension spring 44.

Assuming that the opening degree of the throttle valve 4 is increased with the intake air flow being correspondingly increased during the operation of engine, the pressure in the air pressure chamber 6 formed within the main body 1 will become lower than a preset level so long as the opening degree of the air valve 3 remains unvaried. Such reduction in pressure will be detected by the pressure sensor diaphragm 26 and result in movement of the spool 31 through the arm 28 to the right as viewed in the drawing, which in turn involves a correspondingly increased flow section of the variable fuel constriction or orifice passage constituted by the port 35 and the annular groove 37, while the flow section of the variable constriction or orifice passage constituted by the port 35 and the annular groove 38 is simultaneously decreased. Under such conditions, the pressure in the chamber 42 defined at the rear side of the drive piston 40 is increased, as a result of which the piston 40 is moved to the left as viewed in the drawing, thereby to rotate the air valve 3 in the opening direction against the force of the spring 44. Consequently, resistance to the air flow through the air valve 3 is decreased. This means that the pressure within the air pressure chamber 6 will be raised toward the preset level. On the contrary, when the pressure in the chamber 6 is increased beyond the preset level by decreasing the opening of the throttle valve 4, the spool 31 is displaced from the neutral position to the left, resulting in a decreased fuel flow into the port 35 from the annular groove 37, while the fuel flow from the port 35 into the annular groove 38 is increased. Consequently, the pressure prevailing in the chamber 42 is lowered with the piston 40 being moved rightwards under the action of the spring 44 to rotate the air valve 3 in the closing direction. When the pressure within the air pressure chamber 6 is lowered to the preset value, the spool 31 will then be restored to the neutral position with the air valve 3 being set at a reduced aperture.

As will be appreciated from the foregoing description, the pressure sensor diaphragm 26, the pilot valve 30 and the air valve driving piston 40 constitutes a feedback control circuit which functions to rotate the air valve 3 in the opening direction in response to decrease in the pressure within the air pressure chamber 6, while rotating the valve 3 in the closing direction in response to increase in pressure within the chamber 6, thereby to adjust the opening degree of the air valve 3 so that the pressure within the chamber 6 may be constantly maintained at a preset constant level independently of the intake air quantity. Since the performance of the feedback control circuit is of integration nature, no instability will occur even for an abrupt or rapid change in the intake air quantity. Further, delay in response can be relatively reduced because of use of the high pressure fuel as the operating medium. The pressure level set at the air pressure chamber 6 is determined by the balance among the force exerted to the diaphragm 26, pressure in the reference pressure chamber 48 and the forces of the spring 39.

As will be appreciated from the foregoing description, the pressure within the air pressure chamber 6 formed in the intake conduit, i.e. the pressure prevailing at the downstream side of the air valve 3 is so controlled as to be constant independently of the opening degree of the air valve 3, so far as the balanced condition of forces applied to the spool 31 of the pilot valve 30 remains unvaried. The pressure prevailing at the upstream side of the air valve 3 may be considered as being substantially equal to the atmospheric pressure and constant. Accordingly, the intake air flow through the intake conduit 111 can be made to be exactly proportional to the opening degree of the air valve 3. On the other hand, the fuel metering rod 8 is subjected at the upstream side to a constant pressure from the high pressure fuel source 20 through the conduit 11, while at the downstream side the fuel metering rod 8 is communicated with the fuel injection valve 16 through the conduit 13. The fuel injection valve 16 is opened against the spring 89 to discharge the fuel into the intake conduit 111, when the pressure of fuel metered by the fuel metering rod 8 exceeds a predetermined level. In this manner, fuel is subjected to a constant pressure difference across the variable throttle passage of the fuel metering rod 8. This feature in combination with the interlocked arrangement between the fuel metering rod 8 and the air valve 3 such that flow section of the variable throttle passage may be proportional to the opening degree of the air valve 3 will assure that the flow of fuel flowing through the variable slit passage be proportional to the opening degree of the air valve 3 with a high accuracy. Thus, by virtue of the combination of the air valve and the fuel metering apparatus as described above, the fuel supply can be maintained at a constant ratio relative to the intake air quantity independently of variations thereof, whereby the air-fuel ratio can be constantly maintained at a predetermined value.

Now assuming that the opening degree of the air valve 3 is represented by Aa and pressures at the upstream and the downstream sides of the air valve 3 are represented by Po and Pa, respectively, the intake or sucktion air flow Ga can be expressed as follows:

$$Ga \alpha Aa \sqrt{Po - Pa} \quad (1)$$

On the other hand, if the area of flow section of the variable throttle passage constituted by the fuel metering rod 8 is represented by Af with the pressures at the upstream and downstream sides thereof being represented by Ph and Pc, respectively, the fuel injection quantity Gf can be given by the following expression:

$$Gf \alpha Af \sqrt{Ph - Pc} \quad (2)$$

From the expressions (1) and (2), the air-fuel ratio Ga/Gf is given as follows:

$$Ga/Gf \propto \frac{Aa}{Af} \cdot \frac{\sqrt{Po - Pa}}{\sqrt{Ph - Pc}} \quad (3)$$

Since the air valve control apparatus and the fuel pressure differential apparatus described above function to maintain the conditions Po - Pa and Ph - Pc to be constant and in addition the air valve 3 is so interlocked with the fuel metering rod 8 that the ratio Aa/Af may be constant, the air-fuel ratio Ga/Gf is maintained constant.

The present invention contemplates to vary the condition Po - Pa in dependence on the environmental and operating conditions of the internal combustion engine and correct the air-fuel ratio at an optimum value for the operation of the engine. Now, assuming that the pressure difference Po - Pa is increased by 10%, the ratio of the normal air-fuel ratio to the air-fuel ratio to be corrected will then become equal to $1/\sqrt{1.1}$, which indicates that the fuel concentration will be decreased about 5%. On the contrary, when the pressure difference Po - Pa is decreased by 10%, the fuel concentration or density will be increased about 5%.

As described hereinbefore, the pressure Po at the upstream side of the air valve 3 is substantially equal to the atmospheric pressure, while the pressure Pa prevailing at the downstream side, i.e. in the air pressure chamber 6 is determined by the balance among the force applied to the diaphragm 26, the pressure in the reference pressure chamber 48 of the pilot valve 30 and the force of the spring 39. Thus, the pressure Pa can be varied by varying this balanced condition. For example, it is assumed that the pressure Pa is at a given level and that the spool 31 of the pilot valve 30 is at the neutral position in the balanced condition. Starting from this condition, if the pressure within the reference pressure chamber 48 is reduced, then the spool 31 will be displaced rightwards as viewed in the drawing, whereby the port 35 is much communicated with the high pressure fuel source 20. Consequently, the pressure within the chamber 42 defined by the piston 40 is increased. The piston 40 thus acts to move the air valve 3 in the open direction against the spring force, resulting in increase of the pressure Pa in the air pressure chamber 6. Such increase in pressure Pa is detected by the diaphragm 26 which will then displace the spool 31 to the left through the arm 28 and the link 29 so that a new balanced condition is obtained with the pressure Pa being set at a higher level. On the contrary, assuming that the pressure within the reference pressure chamber 48 is raised, the air valve 3 is then caused to rotate in the closing direction, involving eventually a new balanced condition with the pressure Pa being set at a lower level. In this manner, the pressure Pa is raised when the pressure in the chamber 48 of the pilot valve 30 is reduced and vice-versa. With the present invention, it is intended to automatically increase or decrease the pressure level within the reference pressure chamber 48 as a function of the environmental and operating conditions of the internal combustion engine thereby to correct the air-fuel ratio so as to be optimum by correspondingly varying the pressure difference Po - Pa produced across the air valve 3.

Now, an apparatus incarnating the teachings of the invention will be described by way of example with reference to FIG. 2. As described hereinbefore, the pressure chamber 48 is communicted to the high pressure fuel source 20 through the fixed throttle portion 49. Additionally, the reference pressure chamber 48 is communicated with a first correction chamber 53 and a second correction chamber 54 through a conduit or passage 50. In more detail, the first correction chamber 53 is connected to the conduit 50 through a fixed throttle 55 as well as another fixed throttle 56 and a bimetal valve 57 both disposed in parallel with the throttle 55. Besides, the correction chamber 53 is also communicated to the low pressure fuel source 25 through a fixed or unvariable throttle 58 as well as through another fixed throttle 59 and a bellow valve 60 both disposed in parallel with the throttle 58. A second correction chamber 54 is connected to the conduit 50 through a fixed throttle 61 on one hand and communicated with the high pressure fuel source 20 through an electromagnetic valve 62 and a fixed throttle 63. Additionally, the second correction chamber 54 is communicted with a variable volume chamber 66 of a sensor for detecting acceleration and deceleration through a fixed throttle 64 and a check valve 65 disposed in parallel with the former. The variable volume chamber 66 in turn is communicated with the high pressure fuel source 20 through a fixed throttle 67. The acceleration/deceleration sensor includes a piston 69 which is interlocked with the throttle valve 4 shown in FIG. 1 through a link represented by a dotted broken line 68. The piston 69 is slidably accommodated within a cylinder 70 and constitutes a part for both of a full sensor valve and an idle sensor valve. The full sensor valve is composed of an inlet port 71 and an outlet port 71 provided at lateral sides of the cylinder 71 in opposition to each other and an annular groove 73 formed in the piston 69. When the throttle valve 4 is nearly at a fully opened position, the groove 73 will come to alignment with both ports 71 and 72 thereby to allow these ports to be communicated with each other. The inlet port 71 is connected to the conduit 50 through a fixed throttle 74, while the outlet port 72 is directly communicated to the first correction chamber 53. The idle sensor valve is composed of an inlet port 75 communicated with the high pressure fuel source 20 and an outlet port 76 provided at the opposite side and axially offset rightwards relative to the inlet port 75, as viewed in FIG. 2. When the throttle valve 4 is positioned at the idle opening, the piston 69 opens the outlet port 76 to allow it to be communicated with the high pressure fuel source 20. The outlet port 76 of the idle detector valve is on the other side communica- with a pressure chamber 80 of a deceleration valve 79 disposed in the fuel conduit 15 through a high boost detector valve 77 and a conduit 78. The pressure chamber 80 of the deceleration valve 79 also is communicated with the first correction chamber 53 through a fixed throttle 81. The high boost detector or sensor valve 77 is subjected to a back pressure of a magnitude equal to the pressure prevailing within the interior 112 of the intake conduit 111 downstream of the throttle valve 4 through a passage 82 opened in the intake conduit. The valve 77 is usually urged to the closing position under the action of a spring 83 and is adapted to be opened, when the outlet port 76 of the idle sensor valve is opened and in addition the pressure within the intake conduit 111 downstream of the throttle valve 4 drops below a predetermined level.

Figure 3:
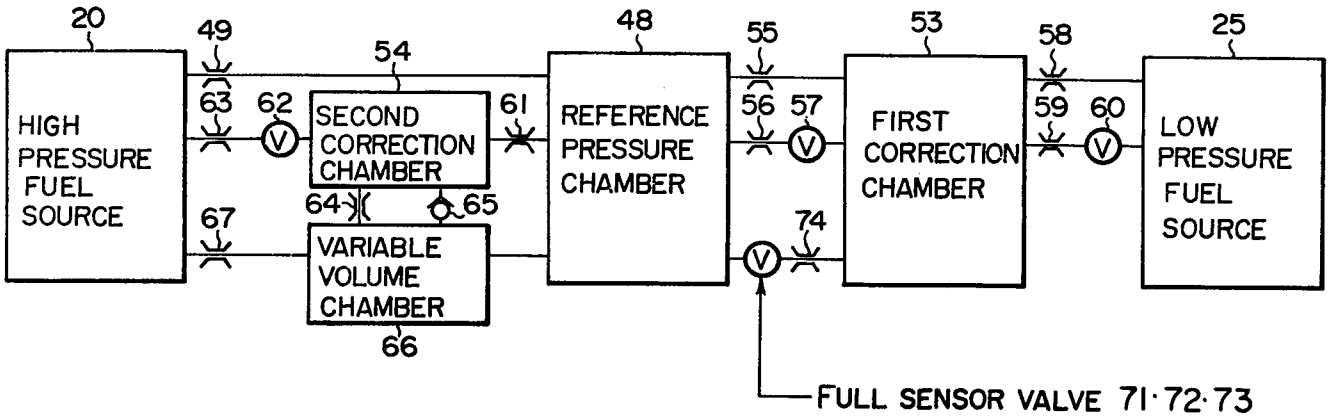
FIG. 3 is a block diagram to illustrate the principle of controlling the air-fuel ratio according to the teachings of the invention.

The above described arrangement of the fuel circuit extending from the high pressure fuel source 20 to the low pressure fuel source 25 through the reference pressure chamber 48 of the pilot valve 30 is schematically illustrated in a block diagram of FIG. 3. Since the pressures in the high pressure fuel source 20 and the low pressure fuel source 25 are maintained at constant differences relative to the atmospheric pressure, respectively, through the high pressure valve 21 and the low pressure valve 24, the pressure level within the reference pressure chamber 48 is determined by resistances and fuel flows established in the individual circuitries provided between the high pressure fuel source 20 and the low pressure fuel source 25. In other words, the pressure within the reference pressure chamber 48 can be varied by changing these resistances and flows. For example, when the electromagnetic or solenoid valve 62 shown also in FIG. 3 is opened, the resistance in the circuit connecting the high pressure fuel source 20 and the reference pressure chamber 48 to each other is decreased, as a result of which the pressure within the reference pressure chamber 48 is raised. The rate of such pressure rise will become higher, as the opening ratio of the electromagnetic valve 62 is increased. Further, when the bimetal valve 57, full sensor valve and/or the bellows valve 60 is opened, the resistance in the circuit extending from the reference pressure chamber 48 to the low pressure fuel source 25 is reduced, resulting in a drop of pressure level in the reference pressure chamber 48. The rate of such pressure drop is determined by combinations of the operating states of the above mentioned valves. Besides, while the volume of the variable volume chamber 66 of the acceleration/deceleration sensor is increased, the pressure in the reference pressure chamber 48 is correspondingly lowered, since the fuel will flow out from the second correction chamber 54 through the check valve 65. On the other hand, while the volume of the variable volume chamber 66 is decreased, the pressure in the pressure chamber 48 is correspondingly raised. In this manner, the pressure within the reference pressure chamber 48 is varied in response to the operating states of the various valves and the change in volume of the variable volume chamber 66, which in turn are automatically controlled in dependence on the environmental and operating conditions of the internal combustion engine, as described hereinafter.

It should be further noted that the fuel feed conduit 15 extending from the fuel metering rod 8 to the fuel injection valve 16 includes further a by-pass conduit extending to the high pressure fuel source 20 through a fixed throttle 84 and an electromagnetic valve 85, which is usually opened. However, upon elapse of time internal determined by the temperature of cooling water after the starting of the engine, the electromagnetic valve 85 is energized to be closed. During the opening of the electromagnetic valve 85, the fuel from the high pressure fuel source 20 is caused to flow directly to the fuel injection valve 16 through the fuel feed conduit 15. The temperature of cooling water is detected by a thermistor 88 mounted on a coolant circulating pipe 87 (s. FIG. 1). Disposed further in the fuel feed conduit 15 between the deceleration valve 79 and the fuel injection valve 16 is another electromagnetic or solenoid valve 86 which is adapted to open so long as an ignition switch is turned on. The fuel injection valve 16 remains in the closed state under the action of a spring 89 when no fuel is fed thereto. Upon supply of the fuel, the valve 16 is opened under increased fuel pressure against the force of the spring 89, whereby the fuel is injected into the intake conduit 111 through the discharge nozzle 17.

In connection with the arrangement just described avove, it is preferred to position an air discharge opening 90 at a right angle to the passage extending between the fuel injection valve 16 and the discharge nozzle 17, thereby to promote atomization of the fuel under the action of air jet. The air discharge port 90 is supplied with air from the upstream side of the air valve 3 through a passage 92 having a fixed throttle 91. The air discharge port 90 is further communicated with the intake conduit 111 upstream of the throttle valve 4 by way of a passage 93, thereby to promote the atomization of the fuel to be injected and at the same time to serve for supplying a part of air metered by the air valve 3 to the engine during the idle operation thereof by by-passing the throttle valve 4. Mounted in the passage 93 is a wax valve 94 which senses the temperature of cooling water and is adapted to increase more the air flow section of the passage 93 as the sensed temperature is lower. In other words, the quantity of air flowing through the passage 93 is progressibly reduced as the temperature of cooling water is raised after the cold starting of the engine. This feature contributes to the improvement of warming-up performance of the engine.

Figure 4A:
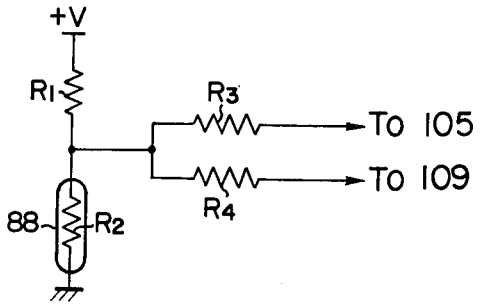
FIGS. 4*a*, 4*b* and 4*c* show electric circuits for controlling electromagnetic valves incorporated in the fuel supply apparatus shown in FIG. 2.
Figure 4B:
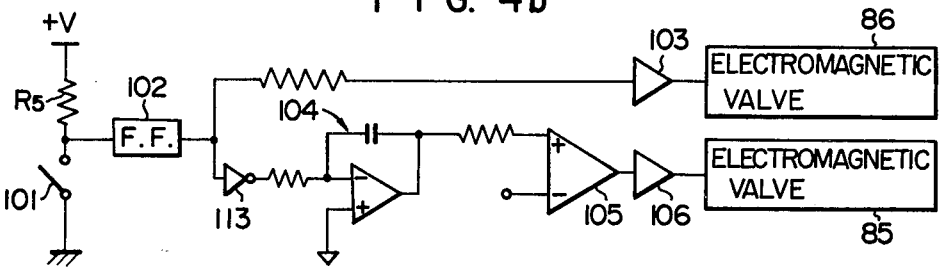
Figure 4C:
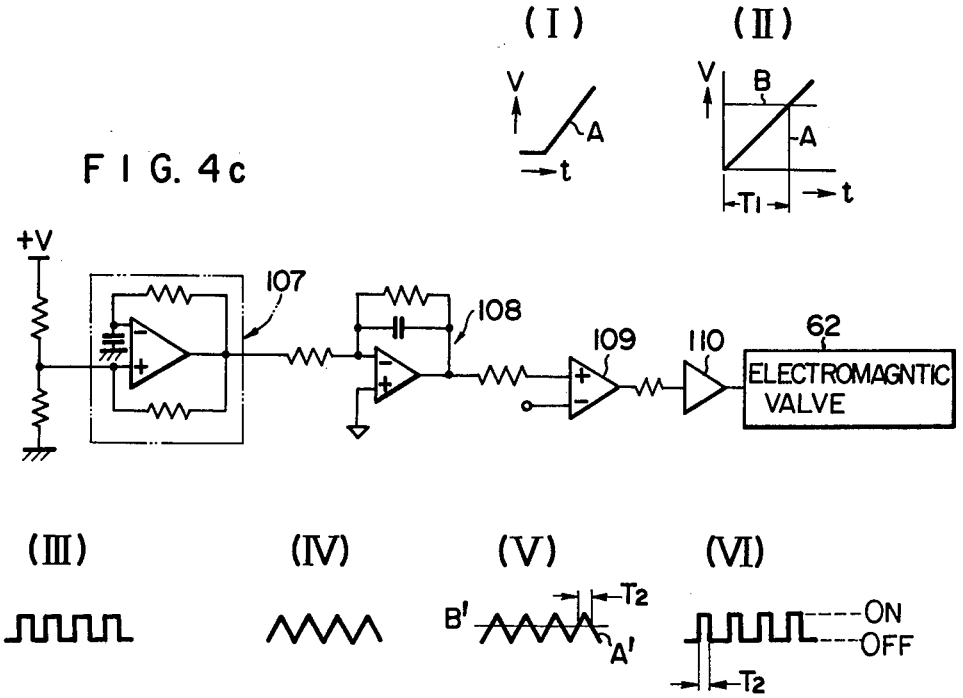

FIGS. 4*a* to 4*c* show electric circuits for controlling the electromagnetic valves 62, 85 and 86 described above. Referring to FIG. 4*c*, the thermistor 88 mounted on the water pipe line 87 (s. FIG. 1) exhibits a negative temperature coefficient, i.e. resistance $R_2$ of the thermistor 88 becomes higher, as the temperature of cooling water is lower. The thermistor 88 has one end grounded and the other end connected to a constant voltage supply source +V through a resistor $R_1$. The voltage appearing across the thermistor or variable resistor $R_2$ which is high for a low temperature of cooling water is applied to an inverting input terminal of a comparator 105 shown in FIG. 4*b* through a resistor $R_3$ and at the same time to an inverting input terminal of a comparator 109 shown in FIG. 4*c* through a resistor $R_4$. In FIG. 4*b*, a starter switch 101 turns on or off the grounded path of a terminal to which a resistor $R_5$ and a flip-flop 102 are connected. The other end of the resistor $R_5$ is connected to the constant voltage source +V. The flip-flop 102 is adapted to produce an output signal only when both of the ignition switch and the starter switch have been closed and remains in this state even when the starter switch is opened, so far as the ignition switch remains closed. The output from the flip-flop 102 is utilized for energizing the electromagnetic valve 86 after having been amplified through an amplifier 103. Further, the output from the flip-flop 102 is applied also to an integrator 104 after having been inverted in polarity through an inverter 113. The integrator 104 produces an output voltage A which is linearly increased as a function of time as illustrated in a graph (I) of FIG. 4. The output voltage A is applied to a non-inverting input terminal of the comparator 105 to be compared with the voltage applied to the inverting input terminal thereof through the resistor $R_3$. When the input voltage applied to the non-inverting input terminal is higher than the one applied to the inverting input terminal, the comparator 105 will produce an output voltage, which is supplied to the electromagnetic valve 85 for the driving thereof after having been amplified through an amplifier 106. As can be seen from a voltage-time diagram (II) of FIG. 4*b*, the time interval $T_1$ elapsed from the time when the flip-flop 102 generates its output signal to the time when the comparator 105 produces its output signal is determined by the distance between the axis of the ordinate V and the intersecting point between the curve A representing the output voltage of the integrator 104 and the line B representing the voltage derived through the resistor $R_3$. Thus the time interval $T_1$ becomes longer, as the voltage B is higher (or temperature of cooling water as detected by the termistor 88 is lower). In other words, the time delay intervening between the turn-on of the starter switch 101 and the energization of the electromagnetic valve 85 becomes greater for lower engine temperature.

Referring to FIG. 4*c*, an oscillator 107 generates a rectangular pulse signal having a predetermined frequency such as shown in a graph (III). This pulse signal is converted into a saw tooth wave pulse signal shown in a graph (IV) through an integrator 108 and applied to a non-inverting input terminal of a comparator 109 which has an inverting input terminal applied with the voltage derived from the thermistor 88 through the resistor $R_4$ to be compared with the saw tooth wave voltage produced from the integrator 108. When the output voltage of the integrator 108 increases beyond the voltage derived through the resistor $R_4$, an output voltage is produced from the comparator 109. This operation is illustrated in a graph (V) of FIG. 4*c*. As can be seen from this graph, the comparator 109 produces a series of pulses having a pulse width $T_2$ corresponding to a time duration determined by the saw tooth wave voltage A' exceeding the thermistor voltage B' derived from the resistor $R_4$ and a frequency equal to that of the output from the oscillator 107. This pulse signal is utilized for energizing the electromagnetic valve 62 after having been amplified through an amplifier 110. The electromagnetic valve 62 is intermittently opened with a frequency equal to that of the oscillator 107 with the opened duration corresponding to the pulse width $T_2$, as illustrated in a graph (VI) of FIG. 4*c*. Thus, the duty ratio of the electromagnetic valve 62 (ratio of the open time duration to a cycle period of opening and closing) becomes smaller, as the engine temperature is lower, because the thermistor voltage B' becomes higher, resulting in a shorter pulse width $T_2$ for a lower temperature of the engine.

The fuel supply apparatus for an internal combustion engine of the construction described above is operated in such a manner as described below. Upon turning on the ignition switch at the time of starting the internal combustion engine, the fuel pump 19 is operated to bring the pressures of the high pressure fuel source 20 and the low pressure fuel source 25 to the respective predetermined pressure levels. The thermistor 88 detects the temperature of the cooling water, as a result of which signal voltage corresponding to the sensed water temperature is set at the inverting input terminals of the comparators 105 (FIG. 4*b*) and 109 (FIG. 4*c*). When the starter switch 101 is now turned on, the flip-flop 102 produces output voltage to open the electromagnetic valve 86. Subsequently, the electromagnetic valve 85 is actuated with the time delay $T_1$. As noted hereinbefore, the valve 85 is of a normally open type. Accordingly, the valve 85 is closed after the time elapse of $T_1$ from the turn-on of the starter switch 101 and continues to remain in the closed state until the ignition switch is turned off. During the opening of the electromagnetic valve 85, the fuel flows from the high pressure fuel source 20 directly into the fuel feed conduit 15. This fuel quantity is fed immediately to the injection valve 16 through the feed conduit 15 upon opening of the electromagnetic valve 86 brought about by the turn-on of the starter switch, thereby to be injected into the intake conduit 111 from the discharging nozzle 17 and supplied to the engine during stating operation. The transient time interval $T_1$ elapsed from the opening of the electromagnetic valve 86 to the closing of the electromagnetic valve 85 is a function of the temperature of cooling water sensed by the thermistor 88 as described hereinbefore, and becomes longer, as the water temperature is lower. When the engine is started, a part of intake air is supplied to the air discharge opening 90 through the passage 93 by-passing the throttle valve 4 to be mixed with the fuel flowing from the injection valve 16 to the fuel discharge nozzle 17, thereby to promote the atomization of fuel. Such partial air supply has a similar effect as the increasing of intake air quantity through the opening of the throttle valve 4 to increase the rotational speed during idling operation and prevent the stalling of the engine during the warming-up operation immediately after the starting. As the temperature of cooling water is raised, the opening degree of the wax valve 94 is reduced, resulting in a decreased by-passing air quantity flowing through the passage 93. In this manner, the warming-up performance is improved and at the same time purification of the exhaust gas from the engine in the starting operation is significantly enhanced.

During the normal operation of the internal combustion engine, the electromagnetic valve 85 is closed and a quantity of fuel as metered by the fuel metering rod 8 will flow into the fuel feed conduit 15, whereby fuel flow controlled at such a rate as to provide a predetermined air-fuel ratio for the intake air quantity is fed to the fuel injection valve 16. This flow rate remains unvariable so far as the pressure in the reference pressure chamber 48 of the pilot valve 30 is constant. In this connection, it should be however noted that the pressure within the pressure chamber 48 is varied in dependence on the environmental and operating conditions of the internal combustion engine according to the invention.

So long as the temperature of cooling water is low, fuel flow into the second correction chamber 54 will be smaller because of a smaller duty ratio of the electromagnetic valve 62 as described hereinbefore by referring to FIG. 4. Under such circumstance, the pressure prevailing within the reference pressure chamber 48 of the pilot valve 30 remains low, whereby the pressure at the downstream side of the air valve 3 is increased to allow the air flow through the air valve to be decreased. On the contrary, when the temperature of cooling water is higher, the duty ratio of the electromagnetic valve 62 is correspondingly more increased, resulting in that the pressure within the pressure chamber 48 is more raised and the quantity of air flow through the air valve 3 is increased. In this manner, the electromagnetic valve 62 regulates the air-fuel ratio in dependence on the temperature of the engine. Of course, the valve 62 is not restricted to the type described above but many other types of valves such as a variable throttle having flow area variable as a function of the cooling water temperature may be employed.

The bellows valve 60 responds to the pressure of the low pressure fuel source 25 and is opened at a high pressure level with the valve opening thereof being enlarged as the pressure level is higher. When the opening of the bellows valve 60 is increased, the fuel flow from the first correction chamber 53 into the low pressure fuel source 25 is correspondingly increased, resulting in a decreased pressure within the reference pressure chamber 48, whereby the concentration of the air-fuel mixture is increased. On the other hand, since the low pressure fuel source 25 is maintained at a predetermined pressure difference relative to the atmospheric pressure through the action of the low pressure valve 24, the pressure of the former is raised as the latter becomes higher. This in turn results in a much enlarged opening of the bellows valve 60 thereby to increase the concentration of the air-fuel mixture. In this manner, the bellows valve 60 serves to provide an optimum air-fuel ratio in accordance with the prevailing atmospheric pressure.

The bimetal valve 57 is destined to respond to temperature of fuel in the first correction chamber 53 and adapted to open at a high fuel temperature and close at a low temperature. Since the fuel in the first correction chamber 53 is circurated from the high pressure fuel source 20 to the low pressure fuel source 25 through the fuel pump 18, the temperature of fuel may be considered as reflecting essentially the temperature of ambient air. Thus, the bimetal valve 57 is opened at a low ambient temperature, involving decrease in the pressure within the reference pressure chamber 48 as accompanied by an increased concentration of the air-fuel mixture. In this way, deviation from the optimum air-fuel ratio due to variation in the specific density of intake air caused by change in the ambient temperature can be corrected or compensated.

The piston 69 of the acceleration/decleration sensor is interlocked with the throttle valve 4. As the throttle valve 4 is opened, the volume of the variable volume chamber 66 is increased. In the meantime, the fuel flows out from the second correction chamber 54 through the check valve 65 thereby to decrease the pressure in the second correction chamber 54, involving an increased concentration of the air-fuel mixture. In this conjunction, it should be mentioned that the pressure within the reference pressure chamber 48 is determined by the ratio between the quantity of fuel supplied through the electromagnetic valve 62 and the quantity of fuel as flowing out through the check valve 65. Accordingly, the pressure within the reference pressure chamber 48 is lowered, as the duty ratio of the electromagnetic valve 62 becomes smaller due to a lower temperature of cooling water. The result will be an increased concentration of the air-fuel mixture. In the course of closing the throttle valve 4, the volume of the variable volume chamber 66 will be concurrently decreased. Under such circumstance, fuel will flow into the second correction chamber 54 through the fixed throttle 64, resulting in a lean air-fuel mixture. In brief, the acceleration/deceleration sensor serves to provide a high concentration of air-fuel mixture during the acceleration of the engine, while providing a low concentration of the air-fuel mixture during the deceleration. The degree of variations in the air-fuel ratio during acceleration or deceleration becomes greater when the engine temperature is at a lower level.

When the throttle valve 4 has been opened substantially fully, the annular groove 73 formed in the piston 69 interlocked with the throttle valve 4 is aligned with the ports 71 and 72. The full sensor valve is thus opened. At that time, the reference pressure chamber 48 is communicated with the first correction chamber 53 through a circuit path extending from the fixed throttle 74 through the now opened full sensor constituted by the port 71, the annular groove 73 and the port 72 in addition to the circuit extending from the fixed throttles 55 and 56 through the bimetal valve 57 to the first correction chamber 53, the pressure in the reference pressure chamber 48 is decreased to enrich the air-fuel mixture. In this manner, an increased fuel supply to the engine can be accomplished during the operation under high load.

When the throttle valve 4 reaches the idle position, the piston 69 functions as the idle detector valve to open the port 76, whereby the fuel is permitted to flow from the high pressure fuel source 20 through the ports 75 and 76 to the high boost detector valve 77. If the pressure prevailing in the intake conduit 111 at that time is very low, the back pressure applied to the high boost detector or sensor valve 77 through the passage 82 becomes low, resulting in that the high boost detector valve 77 is opened and the pressure chamber 80 of the deceleration valve 79 is subjected to the pressure of the high pressure fuel source 20 thereby to close the valve 79. In other words, under the conditions that the throttle valve 4 has reached the idle position and that the pressure within the intake conduit 111 becomes remarkably low as compared with the intake air pressure during idling operation, the deceleration valve 79 is closed to interrupt the fuel supply to the fuel injection valve 16.

Upon turning-off of the ignition switch, the electromagnetic valves 62 and 86 are closed, the electromagnetic valve 85 is opened and the fuel pump 19 is stopped.

As will be appreciated from the foregoing description, it is possible according to the invention to accomplish a fine control of the air-fuel ratio with a relatively simplified structure by virtue of such arrangement that all various factors relating to the operating conditions of an internal combustion engine such as temperature of ambient air, atmospheric pressure, and the temperature, acceleration, deceleration, output power and the like of the internal combustion engine can be reflected as variations in pressure within the reference pressure chamber 48 of the pilot valve 30. The present invention thus contributes to the purification of exhaust gas and at the same time to the fuel economization with the useless fuel supply being suppressed. Additionally, the duty ratio of the electromagnetic valve 62 is varied as a function of the temperature variation of cooling water after the cold starting of the engine thereby to vary continuously the air-fuel ratio until the engine has been warmed-up. This feature in combination with the operation of the wax valve 94 to vary continuously the intake air quantity during idling operation as a function of the temperature of cooling water until the engine has been warmed-up will improve remarkably the warming-up performance of the engine. The fuel supply apparatus according to the invention can be realized inexpensively on a mass production base at a low cost substantially equivalent to that of the apparatus of the carburetor type.

What is claimed is:

1. A fuel supply apparatus for an internal combustion engine, comprising an intake conduit leading to the internal combustion engine; a throttle valve disposed in said intake conduit; an air valve disposed in said intake conduit upstream of said throttle valve so as to define an air pressure chamber within said intake conduit in cooperation with said throttle valve; feedback control means for controlling said air valve including means for generating a signal of a magnitude proportional to pressure prevailing within said air pressure chamber and means responding to said signal for operating said air valve so that the pressure in said air pressure chamber be maintained at a substantially constant preset value; a fuel feed conduit for supplying fuel to a fuel discharge nozzle opened in said intake conduit; variable throttle means interlocked with said air valve and controlled so as to provide a flow area proportional to the opening degree of said air valve; means for maintaining a pressure difference produced across said variable throttle means at a substantially constant level; and means for automatically varying proportional ratio of said signal magnitude to the pressure in said air pressure chamber in dependence on at least one of a plurality of environmental and operating conditions of said internal combustion engine, wherein air-fuel ratio of air-fuel mixture supplied to the internal combustion engine is corrected to an optimum value for the environmental and/or operating conditions of said engine through variation of said preset value of the pressure within said air pressure chamber.

2. A fuel supply apparatus as set forth in claim 1, wherein said signal generating means includes a pilot valve accommodating slidably therein a spool formed with a pressure receiving end surface facing toward a reference pressure chamber defined in said pilot valve, said spool being urged toward said reference pressure chamber under spring load, and adapted to be displaced in response to variation in the pressure within said air pressure chamber, wherein said air valve operating means incudes an hydraulic actuator means subjected to a pressure control in dependence on displacement of said spool of said pilot valve, and wherein the proportional ratio of said signal magnitude to the pressure within said air pressure chamber is varied by varying the pressure within said reference pressure chamber.

3. A fuel supply apparatus as set forth in claim 2, further including a high pressure fluid source and a low pressure fluid source each of which is maintained at a predetermined pressure difference relative to the atmospheric pressure, wherein said reference pressure chamber is communicated with said high pressure fluid source and said low pressure fluid source, respectively, through at least one respective fixed throttle and additionally communicated with said high pressure fluid source and/or said low pressure fluid source through at least one flow control means disposed in parallel with said fixed throttle and adapted to respond to the environmental or operating condition of said internal combustion engine.

4. A fuel supply apparatus as set forth in claim 3, wherein said flow control means comprises a temperature responsive valve which is disposed in a path communicating said reference pressure chamber with said low pressure fluid source and adapted to decrease or increase the opening degree thereof in dependence on increase or decrease in atmospheric temperature, respectively.

5. A fuel supply apparatus as set forth in claim 4, wherein said temperature responsive valve consists of a bimetal valve adapted to respond to temperature of fluid to be controlled by said valve.

6. A fuel supply apparatus as set forth in claim 3, wherein said flow control means includes a pressure responsive valve disposed in a path communicating said reference pressure chamber with said low pressure fluid source and adapted to increase or decrease the opening degree thereof in dependence on increase or decrease in atmospheric pressure.

7. A fuel supply apparatus as set forth in claim 6, wherein said pressure responsive valve consists of a bellows valve adapted to respond to pressure of fluid to be controlled by said valve.

8. A fuel supply apparatus as set forth in claim 3, wherein said flow control means includes a flow control valve disposed in a path communicating said reference pressure chamber with said high pressure fluid source and adapted to increase or decrease the opening degree thereof in dependence on increase or decrease in temperature of said internal combustion engine.

9. A fuel supply apparatus as set forth in claim 8, wherein said flow control valve consists of an electromagnetic valve adapted to be intermittently opened with a duty ratio varying as a function of temperature of cooling water for said internal combustion engine.

10. A fuel supply apparatus as set forth in claim 3, wherein said flow control means includes a variable volume chamber communicated to a path for communicating said reference pressure chamber with said high pressure fluid source to each other and adapted to increase or decrease volume thereof in response to opening and closing operation of said throttle valve.

11. A fuel supply apparatus as set forth in claim 3, wherein said flow control means includes a cut off valve disposed in a path communicating said reference pressure chamber with said low pressure fluid source and interlocked with said throttle valve so as to be opened only when said throttle valve is fully opened.

12. A fuel supply apparatus as set forth in claim 3, further including a first passage having a fixed throttle and communicating said high pressure fluid source with said reference pressure chamber, an electromagnetic valve communicated with said high pressure fluid source through a fixed throttle and adapted to be intermittently opened with a duty cycle increasing or decreasing in dependence on increase or decrease in temperature of cooling water for said internal combustion engine, a second correction chamber communicated directly with said electromagnetic valve and with said reference pressure chamber through a fixed throttle, a variable volume chamber communicated with said high pressure fluid source through a fixed throttle and further communicated with said second correction chamber through a fixed throttle and a check valve disposed in parallel with the last mentioned fixed throttle and serving to prevent fluid flow toward said second correction chamber, said variable volume chamber being adapted to increase or decrease the inner volume thereof in dependence on opening or closing operation of said throttle valve, a first correction chamber communicated with said reference pressure chamber through a second passage having a fixed throttle and additionally communicated with said low pressure fluid source through a third passage having a fixed throttle, a bimetal valve disposed in parallel with said second passage and communicated with said first correction chamber and with said reference pressure chamber through a fixed throttle and adapted to decrease or increase the opening degree thereof in dependence an increase or decrease of fuel temperature, a cut off valve disposed in parallel with said second passage and said bimetal valve and communicated with said reference pressure chamber and with said first correction chamber through a fixed throttle, said cut off valve being adapted to be opened only when said throttle valve is fully opened, and a bellows valve disposed in parallel with said third passage and communicated with said low pressure fluid source and with said first correction chamber through a fixed throttle, said bellows valve being adapted to increase or decrease the opening degree thereof in dependence on increase or decrease in fluid pressure.

13. A fuel supply apparatus as set forth in claim 3, wherein fluid of said high pressure fluid source and said low pressure fluid source consists of a fuel, and wherein said fuel feed conduit is supplied with fuel from said high pressure fluid source.

14. A fuel supply apparatus as set forth in claim 13, wherein said hydraulic actuator means includes a hydraulic cylinder having a piston operationally connected to said air valve and communicated to said high pressure fluid source and said low pressure fluid source through said pilot valve so as to be hydraulically controlled in dependence on displacement of said spool.

* * * * *

UNITED STATES PATENT AND TRADEMARK OFFICE

CERTIFICATE OF CORRECTION

PATENT NO. : 4,211,201

DATED : July 8, 1980

INVENTOR(S) : Masaharu SUMIYOSHI, Setsuro SEKIYA, Katsuhiko MOTOSUGI, Junzo UOZUMI, Tsuneo ANDO, Yuzo TAKEUCHI & Mikio MINOURA It is certified that error appears in the above-identified patent and that said Letters Patent are hereby corrected as shown below:

In the heading

Item [73], change "Asian Industry Co., Ltd." to

-- Aisan Industry Co., Ltd. --

Signed and Sealed this

Tenth Day of February 1981

[SEAL]

Attest:

RENE D. TEGTMEYER

Attesting Officer

Acting Commissioner of Patents and Trademarks